United States Patent [19]

Nasatka

[11] Patent Number: 4,893,119

[45] Date of Patent: Jan. 9, 1990

[54] METHOD AND APPARATUS FOR OPERATING A VEHICLE BARRICADE

[75] Inventor: Kenneth F. Nasatka, Clinton, Md.

[73] Assignee: Nasatka Barrier, Inc., Clinton, Md.

[21] Appl. No.: 93,556

[22] Filed: Sep. 8, 1987

[51] Int. Cl.[4] ..... E01F 13/00

[52] U.S. Cl. ..... 340/928; 404/6; 49/49

[58] Field of Search ..... 404/6; 340/22, 51, 928, 340/114 B, 908.1, 932.2; 246/125, 292, 293; 49/49

[56] References Cited

U.S. PATENT DOCUMENTS

| | | | |
|---|---|---|---|
| 3,681,751 | 8/1972 | Le Barre | 340/22 |
| 3,724,333 | 4/1973 | Fonden et al. | 244/110 F X |
| 3,777,139 | 12/1973 | Peel | 246/125 |
| 3,781,541 | 12/1973 | Darrow et al. | 246/125 X |
| 3,869,104 | 3/1975 | Gallo | 244/110 C |
| 3,876,973 | 4/1975 | Griebel | 340/928 |
| 4,090,685 | 5/1978 | Pappas | 246/125 |
| 4,332,503 | 6/1982 | Hurst, Jr. | 404/355 |
| 4,367,925 | 1/1983 | Sprague et al. | 350/355 |
| 4,490,068 | 12/1984 | Dickinson | 404/6 |
| 4,627,763 | 12/1986 | Roemen et al. | 404/6 |
| 4,630,395 | 12/1986 | Nasatka | 49/49 |
| 4,652,862 | 3/1987 | Verslyeken | 340/540 |
| 4,711,608 | 12/1987 | Ghusn | 404/6 |
| 4,733,081 | 3/1988 | Mizukami | 250/341 |

*Primary Examiner*—Joseph A. Orsino
*Assistant Examiner*—Brian R. Tumm
*Attorney, Agent, or Firm*—Shlesinger & Myers

[57] ABSTRACT

A method of operating a vehicle barricade comprising the steps of providing an hydraulic system comprising an electrically operated motor and a passive accumulator, the hydraulic system is operably connected to a barrier for causing the barrier to be displaced between a first lowered position and a second raised position. The presence of obstructions disposed below the barrier is monitored and the barrier is prevented from being displaced to the first position upon the detection of an obstruction. An electromechanical valve is electrically operated for causing the motor to displace the barrier between the positions. The valve is electrically operated causing the accumulator to displace the barrier between the positions when the motor is not operating. The barrier is displaced to the second position upon the occurrence of a defined emergency condition.

33 Claims, 5 Drawing Sheets

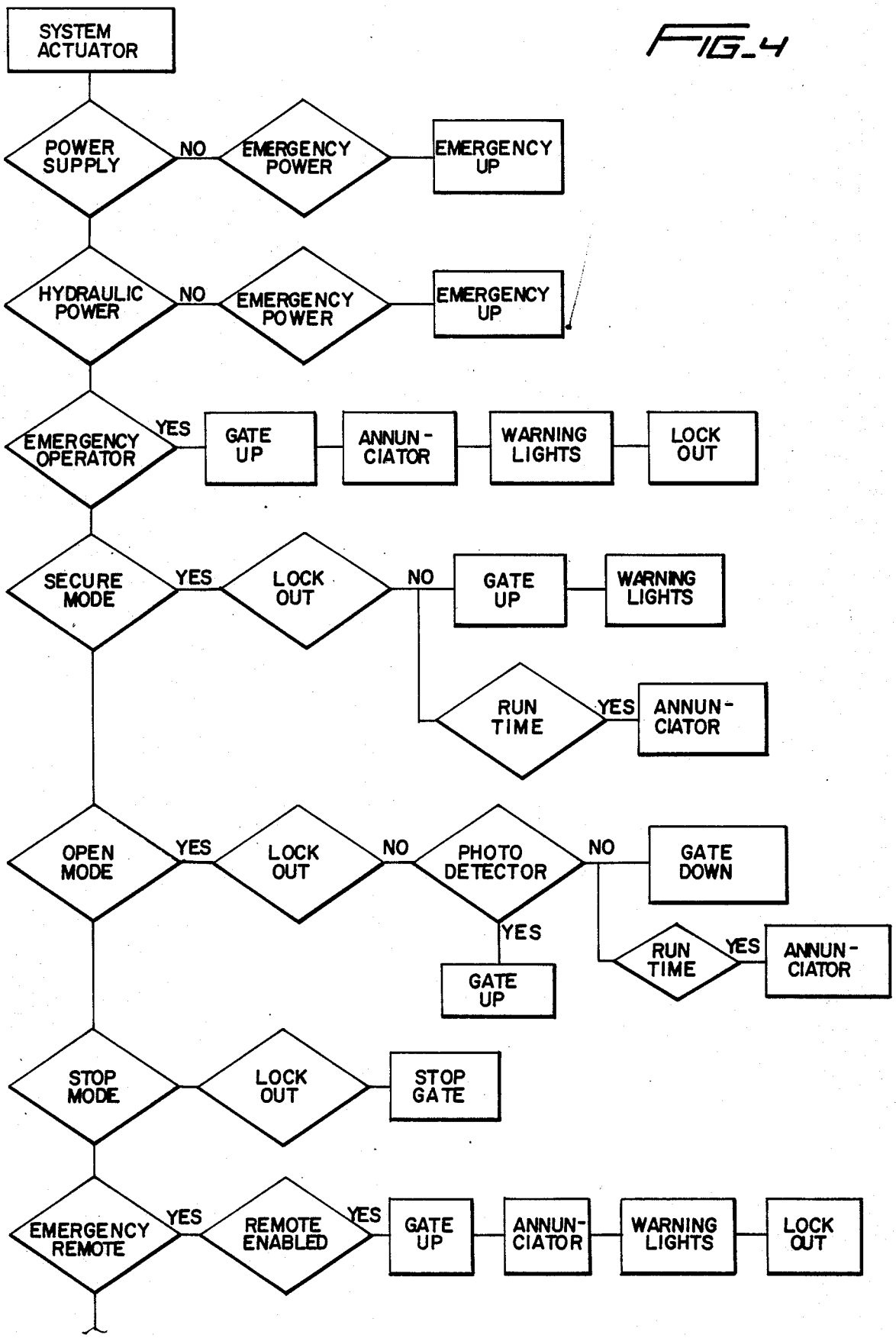
FIG_4
SYSTEM ACTUATOR
POWER SUPPLY
NO
EMERGENCY POWER
EMERGENCY UP
HYDRAULIC POWER
NO
EMERGENCY POWER
EMERGENCY UP
EMERGENCY OPERATOR
YES
GATE UP
ANNUN-CIATOR
WARNING LIGHTS
LOCK OUT
SECURE MODE
YES
LOCK OUT
NO
GATE UP
WARNING LIGHTS
RUN TIME
YES
ANNUN-CIATOR
OPEN MODE
YES
LOCK OUT
NO
PHOTO DETECTOR
NO
GATE DOWN
YES
GATE UP
RUN TIME
YES
ANNUN-CIATOR
STOP MODE
LOCK OUT
STOP GATE
EMERGENCY REMOTE
YES
REMOTE ENABLED
YES
GATE UP
ANNUN-CIATOR
WARNING LIGHTS
LOCK OUT

METHOD AND APPARATUS FOR OPERATING A VEHICLE BARRICADE

BACKGROUND OF THE INVENTION

A vehicle barricade is a device which is disposed across a roadway for interdicting traffic along the roadway. The barricade normally comprises a barrier plate which is pivotal between a lowered, passage permitting position, and a raised, passage preventing, position. The barrier plate is normally pivoted by means of an hydraulic cylinder and piston assembly, and the operating mechanism may be disposed below or above ground. Also, a guard booth is conveniently located, in many applications, adjacent the barricade in order to permit personal observance of the vehicle and its occupants.

The guard operating the barricade has, heretofore, been required to continuously monitor a great many operations, including the mechanisms used for operating the barricade, the barricade itself, as well as the approaching vehicle and occupants thereof. Many locations have a high use rate, thereby increasing the tendency of the guard to be distracted from his surveillance of the many operations which he must monitor. Failure to continuously monitor all required operations may result in the barricade being unusable when most required, such as in the event of a terrorist attack.

From the above, it can be seen that there is a need for a barricade system which minimizes the number of operations which the guard must monitor. It is desirable that the guard be able to concentrate on the approach of vehicles, and their occupants, and not be distracted by other ancillary matters, such as equipment operation.

The disclosed invention is an apparatus and method for operating a vehicle barricade which permits the guard to concentrate his attention on the approaching vehicles, and minimizes his monitoring of equipment operations. The apparatus is expandable for handling a number of barricades, and a central processor performs the equipment monitoring operations, and notifies the guard in the event of a malfunction. Visual indication lamps permit the guard to ascertain the operative condition of all equipment with a mere glance, and inoperative equipment is visually and audibly brought to his attention. Furthermore, the central controller automatically pivots the barrier plate to the raised position in the event of any one of a number of defined emergency conditions, and also permits the barricade to be operated automatically without a guard.

OBJECTS AND SUMMARY OF THE INVENTION

The primary object of the disclosed invention is an apparatus and method for operating a vehicle barricade which permits the guard to concentrate his attention on the approaching vehicles, and which has a central controller for monitoring equipment operations and for bringing equipment malfunctions to the attention of the guard, both visually and audibly, as well as for taking appropriate actions to initiate back-up systems and safety measures in the event of an emergency condition or equipment malfunction.

The method of operating a vehicle barricade according to the invention comprises the steps of providing hydraulic means comprising electrically operated motor means and passive accumulator means, the hydraulic means is operably connected to a barrier for causing the barrier to be displaced between a first lowered position and a second raised position. Monitoring for the presence of obstructions below the barrier is performed and the detection of an obstruction causes means to be initiated which prevent the barrier from being displaced to the first position. First switch means powered from a first power source are operably connected to an electromechanical valve means for causing the motor means to displace the barrier between the positions, while a second switch means powered from a second power source causes the accumulator means to displace the barrier between the positions when the motor means is not operating. The barrier is also displaced to the second position upon the occurrence of any one of a number of defined emergency conditions.

An operating system for a barricade disposed across a roadway includes a barrier pivotal between a first lowered position and a second raised position, and with the barrier being in operable connection with hydraulic means comprising an electrically operated motor means and a passive accumulator and which includes electromechanical valve means interposed between the barrier and the hydraulic means for controlling pivoting of the barrier. A first switch means is in operable connection with the valve means for causing operation of the valve means. A first power supply means is in operable connection with the switch means and the valve means for causing the motor means to supply hydraulic fluid. A second power supply means is in operable connection with the switch means and the valve means for causing the accumulator to supply hydraulic fluid for pivoting of the barrier. A control means is in operable connection with the hydraulic means and the power supply means for monitoring continuous operation thereof and for causing pivoting of the barrier to the second position upon the cessation of operation. A second switch means is in operable connection with the first switch means and with the valve means for causing the barrier to pivot to the second position and for thereafter preventing the barrier from pivoting to the first position in the even t of an emergency condition.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
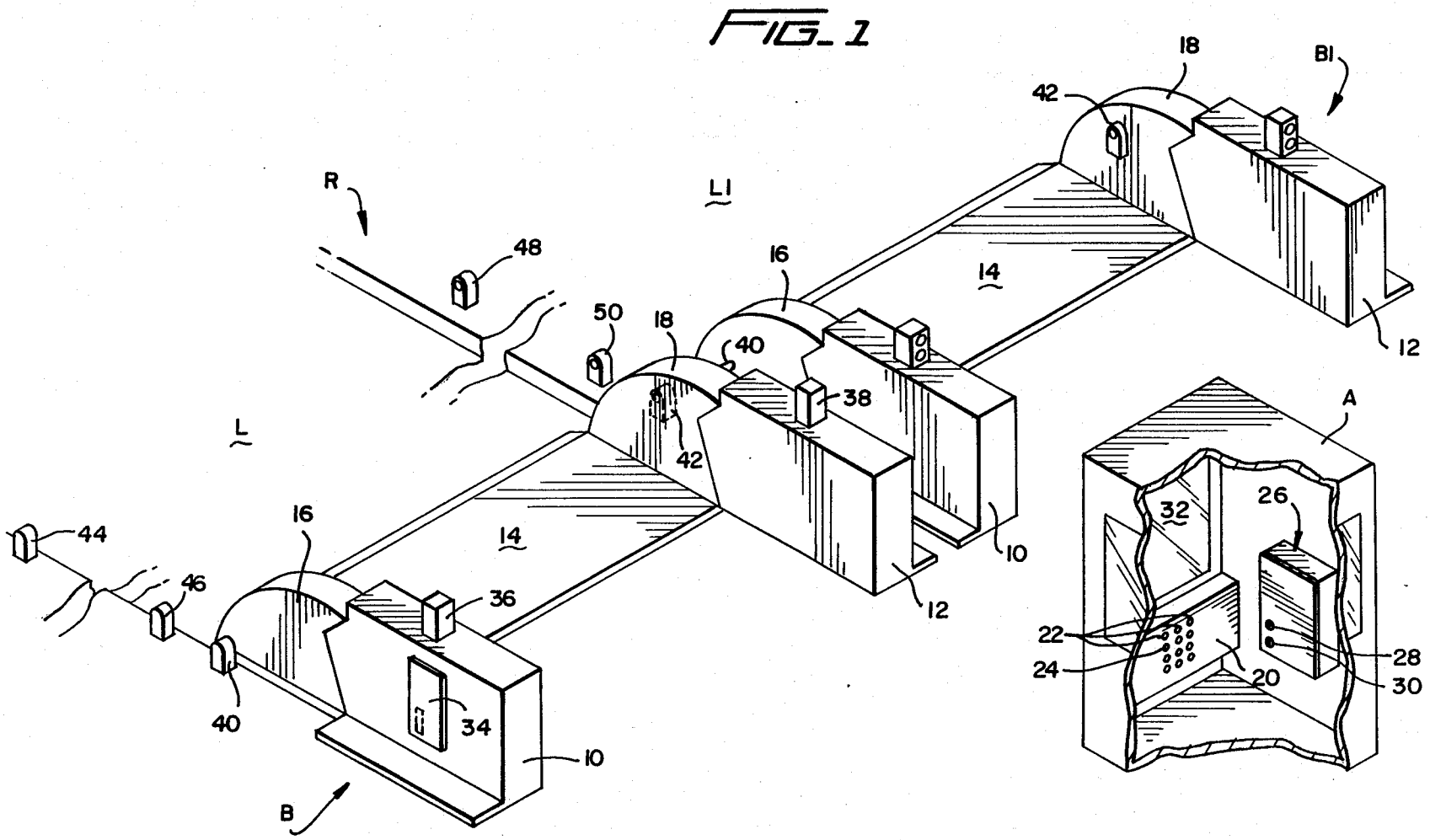
FIG. 1 is a fragmentary perspective view with portions broken away illustrating a barricade system according to the invention.

Barricades B and B1, as best shown in FIG. 1, are disposed across lanes L and L1 of roadway R. An attendant's booth A is disposed proximate the barricades B and B1, preferably in visual association therewith, to permit monitoring of vehicles approaching the barricades. While two barricades are illustrated, those skilled in the art will understand that a greater or fewer number may be required depending on the location to be controlled.

The barricades B and B1 each include side supports 10 and 12 which straddle the associated lane of roadway R. Barrier plates 14 extend between the supports 10 and 12 and are pivotal between a first lowered position, wherein traffic may pass between the supports, and a second raised position, wherein traffic is prevented from passing between the associated supports. Preferably, the hydraulic cylinder and piston assembly for pivoting each barrier plate 14 is positioned within one of the supports 10 and 12. Cover plates 16 and 18 are secured to the barrier plates 14 and extend from the supports 10 and 12, respectively, to prevent access to the internally mounted cylinder and piston assembly. In this way, unauthorized access to the cylinder and piston assembly is prevented, and thereby pivoting of the barrier plate 14 is further assured.

Attendant's booth A includes a control panel 20 having a series of indicator lamps 22 and pushbuttons 24. Each of the lamps 22 is operably associated with some particular piece of operating equipment and is, preferably, continuously illuminated when that piece of equipment is operating. In this way, a non-illuminated lamp indicates that the particular piece of equipment is not operating, and this can be quickly perceived with only a glance. The pushbuttons 24, on the other hand, have the function of initiating operation of equipment, or otherwise controlling some aspect of the barricades B and B1 and the related equipment. Those skilled in the art will understand that the control panel 20 will have a relatively large number of indicating lamps 22 and pushbuttons 24, depending upon the number of pieces of equipment being monitored and operated.

Control box 26 is also positioned within attendant's booth A and has key initiation and reset assemblies 28 and 30, each of which is operably connected with the control system of one of the barricades B and B1, for reasons to be explained. The attendant's booth A has windows 32 to permit visual monitoring of the barricades B and B1. Preferably, the attendant's booth A is locked and maintained secured in order to prevent unauthorized access to the booth A, and to the equipment contained therein.

A remote control station 34 is mounted to one of the supports 10 and 12 of each of the barricades B and B1. The remote control stations 34 are operably connected with control panel 20 and control box 26 by appropriate lines, cables and the like, which are, preferably, underground. The control stations 34 include switches or pushbuttons for causing operation of the associated barrier plates 14. The control panel 20, preferably, includes switches or pushbuttons for disabling the associated remote control panels 34, thereby preventing unauthorized pivoting of the barrier plates 14 and assuring absolute control over the operation of the barricades B and B1.

Indicator lamps 36 and 38 are mounted atop the supports 10 and 12, respectively, in order to provide a visual indication to an approaching vehicle of the position of the associated barrier plate 14. For example, the indicating lamps 36 and 38 may be continuously lit when the associated plate 14 is in the raised position, whereas the lamps could be intermittently operated when the associated plate 14 is in the lowered position. While I have illustrated the lamps 36 and 38 as being disposed atop each of the supports 10 and 12, respectively, those skilled in the art will understand that the lamps could be mounted in some other location, and only one indicating lamp is necessary.

The barrier plates 14 must pivot into the lowered position, wherein the plates 14 are parallel to the associated lanes L and L1, for vehicles to be able to pass between the associated supports 10 and 12 and along the roadway R. Should some obstacle be positioned below a plate 14, then that plate 14 will not be capable of being pivoted into the lowered position. For this reason, I provide an obstruction detection system, comprising light sources 40 and light detectors 42, monitoring the area below the barrier plates 14. The detectors 42 are operably connected to the control panel 20 and prevent the associated plate 14 from being pivoted into the lowered position should an obstruction be detected. This prevents the plates 14 from being damaged by an obstruction, and also helps to prevent the plates 14 from being lowered onto an individual, thereby increasing safety. The light sources 40 may include any one of a number of electromagnetic radiation sources, such as those operating in the infrared spectrum. Although only one obstacle detection system, 40 and 42, is illustrated in FIG. 1, those skilled in the art will understand that a system is provided for each of the barricades B and B1.

Similar light sources 44 and 46 and detectors 48 and 50 are disposed along the roadway R in spaced apart relation for each of the lanes. The detectors 48 and 50 are operably connected with the control box 26 and permit the approach of a vehicle to be detected, as well as the speed of the vehicle to be ascertained. Speed of the vehicle may be determined because the detectors 48 and 50 are a known distance apart, so that the time required to trip each of the detectors 48 and 50 permits the speed of the approaching vehicle to be calculated by the control processor.

Figure 5:
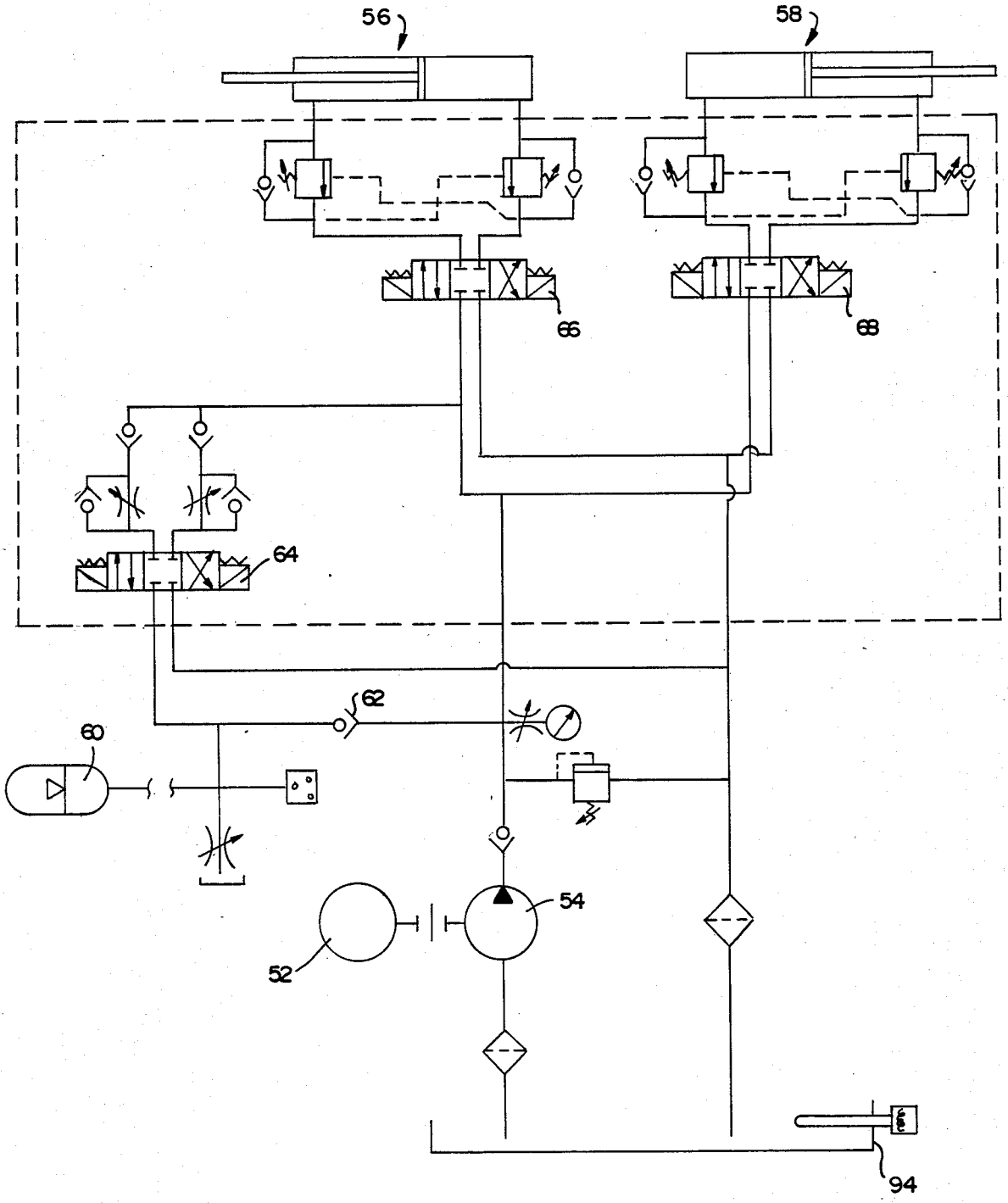

FIG. 5 discloses the hydraulic system used to operate the barricades B and B1 of FIG. 1. The hydraulic system is constructed pursuant to application Serial No. 043,977, filed Apr. 29, 1987, now U.S. Pat. No. 4,818,136, in the name of Ralph G. Nasatka and Michael Lippy for Hydraulic Vehicle Barricade and Method, the disclosure of which is incorporated herein by reference, and the owner of which is also the owner of the present application.

Electric motor 52 operates pump 54 which directs pressurized hydraulic fluid to cylinder and piston assemblies 56 and 58, each of which is operable associated with one of the barricades B and B1 for pivoting the associated barrier plates 14. The pump 54 also supplies pressurized hydraulic fluid to accumulator 60 which stores the fluid because of check valve 62 and which supplies the pressurized fluid to the cylinder and piston assemblies 56 and 58 in response to operation of solenoid valve 64. Directional control valves 66 and 68 are interposed between the pump 54, accumulator 60 and the cylinder and piston assemblies 56 and 58, respectively, for causing the pressurized hydraulic fluid to be appropriately directed to the assemblies 56 and 58 in order to cause operation thereof, and thereby pivoting of the plates 14. I prefer to use solenoid valves for the directional control valves 66 and 68, because solenoid valves are electromechanical in operation and can be operated by electrical pushbuttons, as well as mechanically in the event of a complete loss of operating power.

In this way, the barrier plates 14 can be pivoted as long as there is sufficient pressurized fluid within accumulator 60. Preferably, the motor 52, pump 54 and valves 64, 66, 68 are positioned within booth A or are closely adjacent thereto and in a secure facility.

Figure 3:
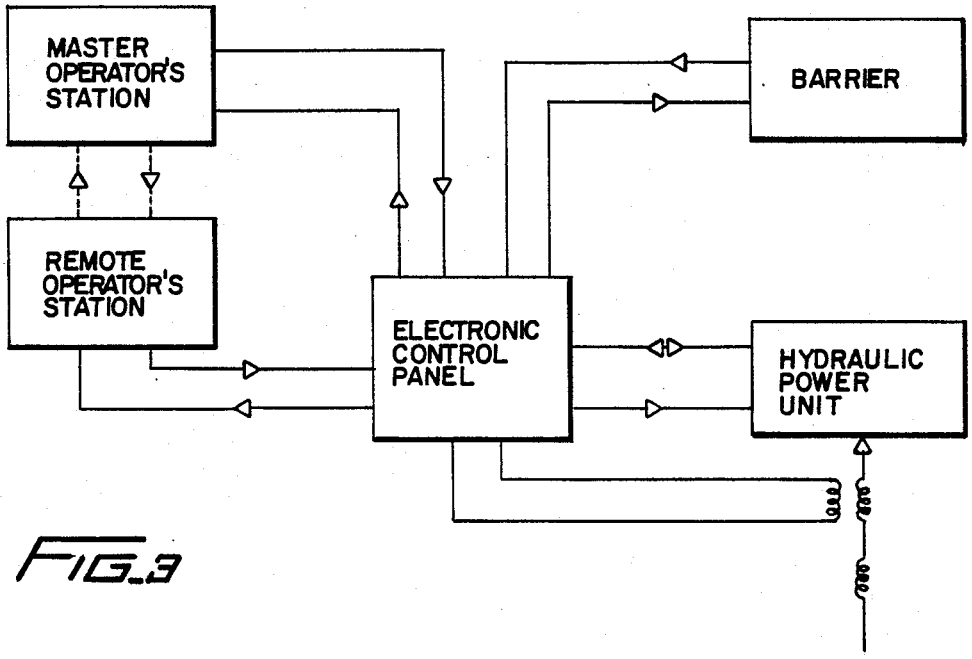
FIG. 3 is a schematic diagram illustrating the control system of the invention.

FIG. 3 discloses the control system utilized in operating the barricades of the invention. FIG. 3 illustrates a single barricade configuration, although those skilled in the art can readily understand how the multiple barricade operation, such as illustrated in FIG. 1, can be adapted to the control scheme.

The electrical control panel, which corresponds to control box 26, is in operable communication with the remote operator's station and the master operator's station. The remote operator's station corresponds to remote control station 34, whereas the master operator's station corresponds to control panel 20. It can be noted that the remote operator's station communicates with the electronic control panel, as does the master operator's station, which similarly communicates with the remote operator's station. The result is that the barrier 14 pivots in response to the first of the two operator's stations indicating that pivoting is necessary, unless one of the defined emergency conditions is present. In other words, the electronic control panel operates on a modified "first input" system, thereby assuring step by step processing of the input signals.

Similarly, the electronic control panel is in operable communication with the hydraulic power unit, and with the barriers and their associated position switches, indicating lamps, etc. It can be noted in FIG. 3 that the hydraulic power unit sends information to the electronic control panel, and also receives information from the electronic control panel, as does the barrier. It should be remembered that the hydraulic power unit includes a motor driven pump and an accumulator, and it is therefore necessary for the electronic control panel to ascertain the operational condition of the hydraulic power unit, such as operation of the motor, operation of the pump, power supplied to the motor and the like.

Figure 2:
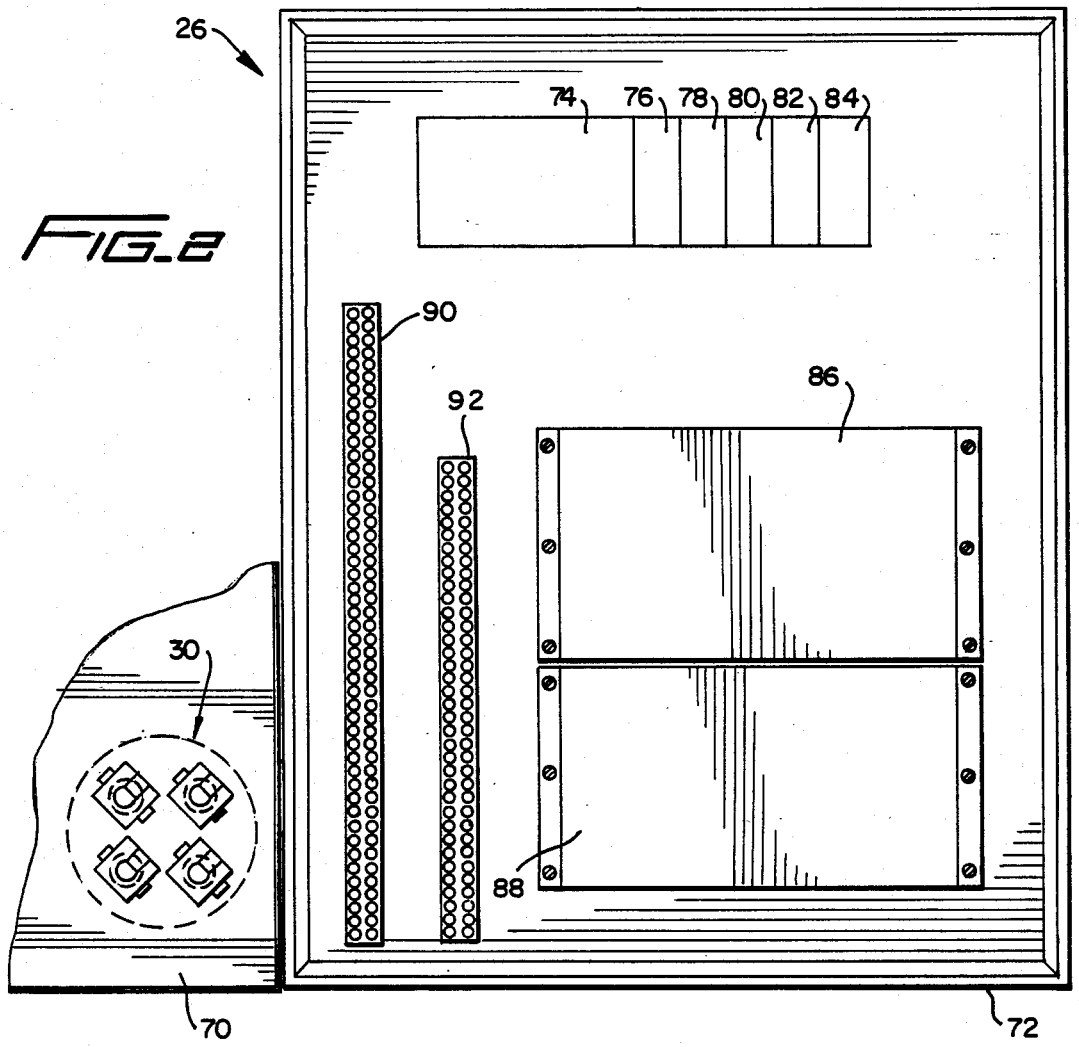
FIG. 2 is a fragmentary elevational view of the control box of the invention in the open position.

FIG. 2 illustrates the control box 26 which is positioned within booth A. Cover 70 is hingedly connected to housing 72 and is secured to same, such as by a lock. Key initiation and reset assemblies 28 and 30 are mounted to cover 70, only the assembly 30 being illustrated in FIG. 2, and disable control panel 20 in the event of any one of a number of defined emergency conditions and also energize panel 20 upon initial start-up and after the emergency has been cleared. The assemblies 28 and 30 therefore prevent the barriers 14 from being pivoted from the remote control stations 34 and likewise prevent the operator from operating the pushbuttons 24 to cause the plates 14 to pivot, unless the resets have been energized. The assemblies 28 and 30, therefore, lock-out the barrier pivoting system and prevent unauthorized pivoting.

Programmable controller 74 is mounted within box 26 and performs the essential control monitoring operations for the barricades B and B1. The controller 74 is an electronic device, of a type well known in the art, and avoids the needs for relays, overloads and the like which are required with conventional electrical systems. The controller 74 is a fully logic operated programmable device which allows for the highest level of safety, security, reliability and flexibility and is a stored program system.

A plurality of input/output devices 76, 78, 80, 82 and 84 are operably connected with controller 74 and take the place of the relays and the like of conventional electrical systems.

The device 76, preferably, controls the alternating current monitor, and thereby assures that the motor 52 is being supplied with power. Similarly, device 78 operates the lamps 36 and 38, as well as the motor starter for the motor 52. The device 80, on the other hand, operates the panel indicating lights 22, whereas device 82 is used in the hydraulic monitoring system. Lastly, the device 84 cooperates with the detectors 42, 48 and 50.

Those skilled in the art will understand that the programmable controller 74, in conjunction with the related input/output devices, provides a control system which is expandable as options are added to the barricades B and B1. Also, while I have indicated that each of the devices 76-84 is used for monitoring a particular function or operation, those skilled in the art will understand that each of the devices can be used to monitor or operate some other device or function.

Battery packs 86 and 88 are positioned within box 26 and provide a back-up source of electric power for operating the solenoids 64, 66 and 68 in the event that the device 76 detects a power failure in the primary A/C power source. The battery packs 86 and 88 provide electric power for energizing the solenoids 64, 66 and 68 and permit the barriers 14 to pivot in response to pressurized hydraulic fluid supplied by passive storage device or accumulator 60. The device 76 automatically causes power to be supplied by the battery packs 86 and 88 as soon as a loss of power is detected so that the change of power supply is transparent to the guard. Similarly, when power is restored, then the device 76 likewise transfers power from the battery packs 86 and 88 to the primary A/C power supply. Operation of the motor 52, once power is restored, therefore permits the accumulator 60 to be recharged.

Terminal strips 90 and 92 are positioned within box 26 and interconnect the various operating elements with the programmable controller 74. The terminal strips 90 and 92 are of a type well known in the art and facilitate wiring of the various operating elements to the controller 74.

CONTROL SCHEME

Figure 4:
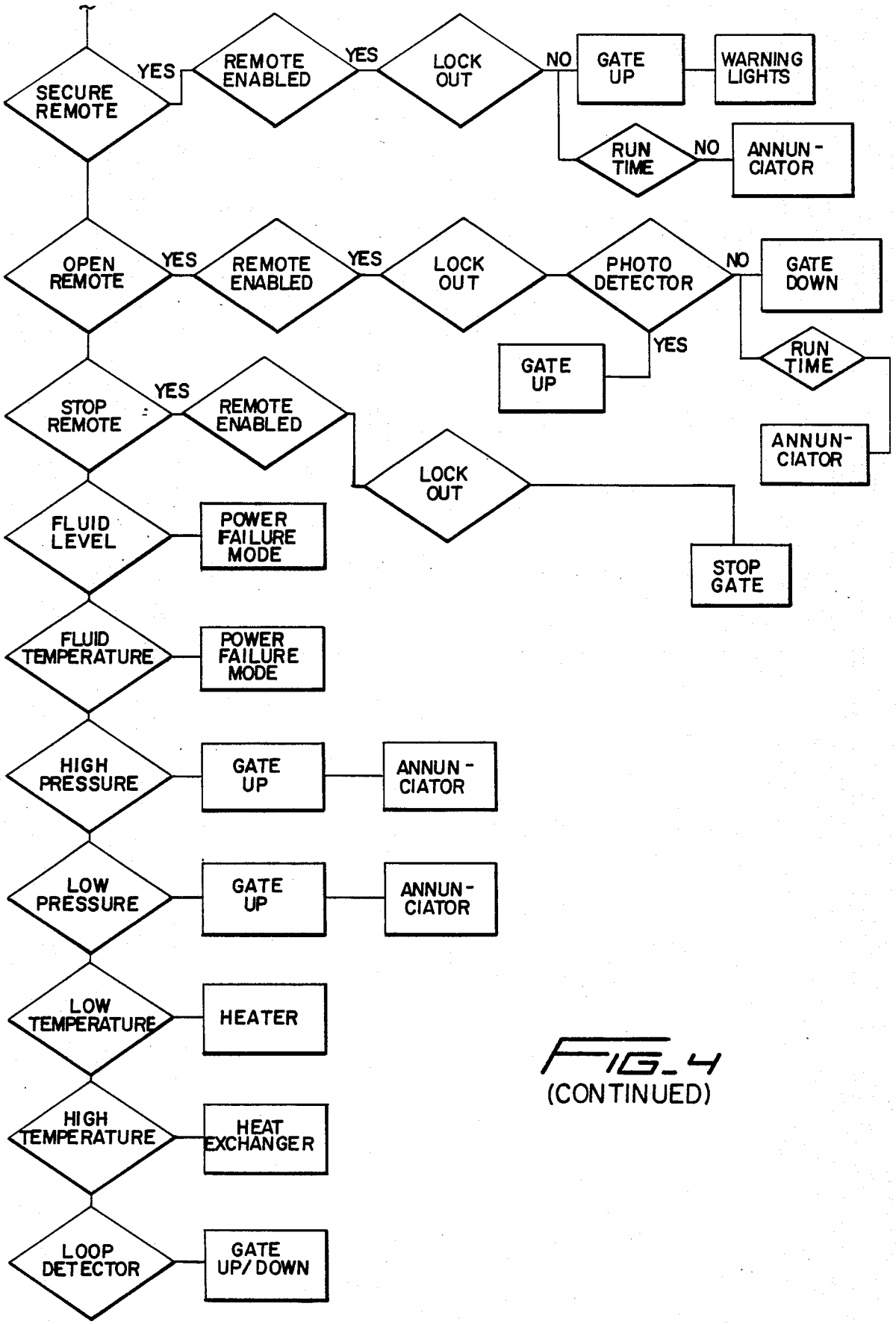
FIG. 4 is a flow diagram illustrating the control algorithm of the invention; and, FIG. 5 is a schematic diagram illustrating an hydraulic system as utilized with the invention.

The programmable controller 74, in cooperation with the input/output devices 76, 78, 80, 82 and 84, provides a control system, illustrated in FIG. 4, which continuously monitors all pertinent operating elements of the barricades B and B1 and permits the guard to keep his attention focused on the approaching vehicles. The controller 74 is, as noted, programmable and is therefore adaptable for monitoring various other elements which might be added, as well as for handling those situations where some elements are inoperative for a particular reason, or are otherwise not present.

Initiation of the operating system causes the primary alternating current power supply to be monitored. Should the A/C power supply be inoperative, then the controller 74 automatically switches to the battery power provided by battery packs 86 and 88. I recommend that the barriers 14 be pivoted to the second or raised position when battery power is activated, and that this be considered a defined emergency condition. In a defined emergency condition the control panel 20 is disabled, until the reset assemblies 28 and 30 are activated, thereby indicating that the emergency condition has been cleared.

The control system of FIG. 4 similarly monitors the hydraulic power provided by pump 54. Should the pump not be operable, the accumulator 60 is then activated for supplying the hydraulic power. As with power failure, failure in the motor 52 or pump 54 is considered a defined emergency condition, and it is therefore recommended that the barriers 14 be pivoted to the second position.

One of the push buttons 24 serves as an emergency operator which overrides all other system inputs and causes the barrier plates 14 to be automatically and immediately pivoted to the second position. An annunciator is positioned in the booth A for audibly indicating this condition. Furthermore, the indicating lamps 36 and 38 are activated. Lastly, the emergency operator pushbutton causes the control panel 20 to be disabled, thereby requiring operation of the reset assemblies 28 and 30 prior to subsequent operation of the barriers 14.

The secure mode is considered to be that wherein the barriers 14 are in the second position. Should the appropriate pushbutton be activated, thereby requesting that the associated plate 14 be pivoted into the second position, then the control system first inquires as to whether the barrier 14 has been locked out in the down position. If not, then the plate or gate is pivoted into the up position and the indicating lamps 36 and 38 are continuously illuminated to warn the approaching vehicle. At the same time, a run time monitor is energized. The run time monitor compares the time required to pivot the barrier 14 to the secure position from the open position, and thereby can detect operational problems, such as blockage at the barrier 14. Should the predetermined run time be exceeded, thereby indicating an operational problem, then the annunciator is sounded and the appropriate lamp 22 extinguished.

should the appropriate open mode, or down position, pushbutton be depressed, then the system inquires whether the barrier 14 has been locked out in the secure mode. If not, then inquiry is made of the detector 42 for an obstruction and, if there is none, then the gate or barrier is pivoted into the down position. Should an obstruction be detected, then the appropriate barrier 14 is either stopped or pivoted to the up or secure position and an indicator lamp 22 extinguished. When the gate being to descend, then the run time monitor is again activated, and the annunciator sounds and a lamp 22 extinguished if the run time is exceeded.

One of the pushbuttons 24 also activates the stop mode. In the stop mode, the barrier 14 is stopped in its position, even if intermediate the raised or lowered position. Once again, the system inquires as to whether the barrier has been locked out, and if not, then the barrier 14 is stopped.

As previously noted, remote control station 34 likewise has pushbuttons for the secure, open, stop and emergency modes. Those pushbuttons and the operation of the control system are illustrated in FIG. 4. The emergency, stop, open and secure remote control pushbuttons operate the same as do the corresponding pushbuttons on the control panel 20, and need not further be explained.

The control system of FIG. 4 also monitors the hydraulic fluid level in the reservoir 94, as well as fluid temperature therein. Should the level be less than a selected level, or should the fluid temperature exceed a selected temperature, then the power failure mode is activated, and this is a defined emergency condition.

Similarly, the controller 74 monitors the pressure in the hydraulic system and causes the gates or barriers 14 to be pivoted into the secure mode and an annunciator sounded should either the pressure exceed a selected level, or be less than a selected level. As before, the appropriate lamp 22 is extinguished.

Many such barricades are positioned in places exposed to extreme temperature fluctuations. The controller 74 therefore monitors the hydraulic fluid temperature and initiates operation of a heater should the fluid temperature become less than desired, and activates a heat exchanger if the temperature becomes too high.

Lastly, as noted, detectors 48 and 50 indicate the presence and speed of an approaching vehicle. These "loop detectors" can cause the barrier 14 to pivot upwardly into the secure mode when a vehicle is approaching the barrier 14, and can also pivot the barrier 14 into the open mode after the vehicle has passed beyond the barrier 14.

Those skilled in the art will understand that the control system of FIG. 4, when combined with the barricades B and B1 of FIG. 1, results in a barricade system which overcomes the prior difficulties of conventional barricades. The control system, as operated through the programmable controller 74, provides for essentially automatic operation of the barricades B and B1 and requires little operator input. The guard or attendant can devote his attention to the approaching vehicle, and not be concerned with the operation of the barriers, or the related ancillary equipment.

While this invention has been described as having a preferred design, it is understood that it is capable of further modifications, uses and/or adaptations of the invention, following in general the principle of the invention and including such departures from the present disclosure as come within known or customary practice in the art to which the invention pertains, and as may be applied to the central features hereinbefore set forth, and fall within the scope of the invention of the limits of the appended claims.

What I claim is:

1. A method of operating a vehicle barricade, comprising the steps of:

(a) providing hydraulic means comprising electrically operated motor driven pump means and passive accumulator means, said hydraulic means for operable connection with a barrier for causing the barrier to be displaced between a first lowered position and a second raised position;

(b) providing a plurality of indicator lights, each light operably associated with one of the pump means and the accumulator means and causing the lights to be continuously illuminated when the associated pump means and accumulator means are in an operative condition and causing the associated light to be extinguished when one of the pump means and accumulator means is not in the operative condition;

(c) electrically operating an electromechanical valve means for causing the motor means to displace the barrier between the positions;

(d) electrically operating the valve means for causing the accumulator means to displace the barrier between the positions when the motor means is not operating;

(e) displacing the barrier to the second position upon the occurrence of a defined emergency condition;

(f) providing a first source of electric power for operating the valve means when the motor driven pump means is operating and a second source of electric power for operating the valve means when the motor driven pump means is not operating;

(g) operably interconnecting the sources and thereby maintaining uninterrupted power supply for operating the valve means;

(h) providing a battery power supply as the second source; and, (i) indicating which of the power supplies is operating the valve means.

2. The method of claim 1, including the steps of:

(a) visually indicating to an approaching vehicle the position of the barrier; and, (b) visually indicating the occurrence of the defined emergency condition.

3. The method of claim 2, including the step of:

(a) audibly indicating the occurrence of the defined emergency condition.

4. The method of claim 1, including the steps of:

(a) monitoring for the presence of a vehicle approaching the barrier; and, (b) automatically causing the barrier to be displaced to the second position when a vehicle is detected.

5. The method of claim 4, including the steps of:

(a) monitoring for the vehicle approaching the barrier with a plurality of speed sensors for determining the speed of the approaching vehicle; and, (b) automatically causing the barrier to be displaced to the second position when the speed of the approaching vehicle exceeds a selected level.

6. The method of claim 1, including the steps of:

(a) providing a remote control station remotely located from the hydraulic means and operably connected to the valve means and a control station proximate the hydraulic means and operably connected to the valve means;

(b) operating the valve means from the first one of the control station and remote control station to be operated and thereby causing displacement of the barrier.

7. The method of claim 6, including the step of:

(a) disabling from the control station the remote control station and thereby preventing displacement of the barrier in response to operation of the remote control station.

8. The method of claim 6 including the step of:

(a) providing means preventing operation of the valve means and monitoring the preventing means prior to causing the barrier to be displaced by the control and remote control stations.

9. The method of claim 6, including the step of:

(a) determining the occurrence of the defined emergency condition prior to operating the valve means from either of the control and remote control stations.

10. The method of claim 1, including the step of:

(a) preventing operation of the valve means after the barrier has achieved the second position upon the occurrence of the defined emergency condition.

11. The method of claim 1, including the steps of:

(a) monitoring the pressure of said hydraulic means and the cessation of operation of said motor driven pump means being a first defined emergency condition; and, (b) monitoring the supply of electric power and the loss of electric power being a second defined emergency condition

12. The method of claim 1, including the step of:

(a) monitoring the time required for the barrier to be displaced between the positions and indicating when the displacement time exceeds a selected period.

13. The method of operating a vehicle barricade, comprising the steps of:

(a) providing hydraulic means comprising electrically operated motor driven pump means and passive accumulator means, the hydraulic means for operable connection with a barrier for causing the barrier to be displaced between a first lowered position and a second raised position;

(b) providing a plurality of indicator lights, each light operably associated with one of the pump means and the accumulator means and causing the lights to be continuously illuminated when the associated pump means and accumulator means are in an operative condition and causing the associated light to be extinguished when one of the pump means and accumulator means is not in the operative condition;

(c) electrically operating an electromechanical valve means for causing the motor means to displace the barrier between the positions;

(d) electrically operating the valve means for causing the accumulator means to displace the barrier between the positions when the motor means is not operating;

(e) displacing the barrier to the second position upon the occurrence of a defined emergency condition;

(f) providing a remote control station remotely located from the hydraulic means and operably connected to the valve means, and a control station proximate the hydraulic means and operably connected to the valve means; and, (g) operating the valve means from the first one of the control station and remote control station to be operated and thereby causing displacement of the barrier.

14. The method of controlling passage along a roadway, comprising the steps of:

(a) providing a vehicle barricade along a roadway, the barricade comprising a barrier disposed across a roadway and being pivotal between a first lowered position and a second raised position and including cylinder and piston means operably connected to the barrier for pivoting the barrier between the positions;

(b) providing hydraulic means comprising electrically operated motor means and passive accumulator means in operable connection with the cylinder and piston means for causing operation thereof and pivoting of the barrier;

(c) interposing electromechanical valve means between the hydraulic means and the cylinder and piston means for controlling operation of the cylinder and piston means and thereby pivoting of the barrier;

(d) providing an attendant's booth, the booth including a control station with first switch means in operable connection with the valve means for controlling operation thereof and thereby pivoting of the barrier;

(e) providing a first power source in operable connection with the switch and valve means for causing the motor means to pivot the barrier and a second power source in operable connection with the switch and valve means for causing the accumulator means to pivot the barrier;

(f) automatically pivoting the barrier to the second position upon the occurrence of a defined emergency condition;

(g) providing a plurality of indicator lights in the attendant's booth, each light operably associated with one of the motor means and accumulator means and causing the lights to be continuously illuminated when the associated motor means and accumulator means are in an operative condition and causing the lights to be extinguished when the associated motor means and accumulator means are not in the operative condition;

(h) operably interconnecting the power sources so that loss of power from one source causes automatic transfer to the other source, and the second source including a battery supply;

(i) monitoring the operation of the motor means and cessation of operation thereof being a first defined emergency condition; and, (j) monitoring the supply of power from the first source and loss of power therefrom being a second defined emergency condition.

15. The method of claim 14, including the step of:

(a) providing means disposed along the roadway for detecting the approach of a vehicle and said detecting means in operable connection with said valve means for pivoting said barrier to said second position upon the detection of an approaching vehicle.

16. The method of claim 14, including the step of:

(a) providing means disposed along the roadway for detecting the approach of and speed of a vehicle, said detecting means in operable connection with said valve means for pivoting of said barrier to said second position upon the detection of an approaching vehicle having a speed in excess of a defined limit.

17. The method of claim 14, including the step of:

(a) positioning a remote control station proximate the barricade and in operable connection with the booth control station and the remote control station including second switch means and causing operation of the valve means and thereby pivoting of the barrier in response to the first one of the first and second switch means to be operated.

18. The method of claim 17, including the step of:

(a) providing means in said booth for disabling said remote control station and thereby preventing pivoting of said barrier in response to said second switch means.

19. The method of claim 14, including the steps of:

(a) providing secure mode initiation means in said booth; and, (b) initiating said initiation means upon the occurrence of the defined emergency condition and said initiation means preventing pivoting of said barrier to said first position after said barrier has attained said second position.

20. The method of claim 14, including the steps of:

(a) visually indicating to an approaching vehicle the position of said barrier; and, (b) audibly indicating the occurrence of the emergency condition.

21. The method of claim 14, including the steps of:

(a) providing a second barricade disposed along the roadway, said second barricade comprising a second barrier disposed across the roadway and being pivotal between a first lowered position and a second raised position and including second cylinder and piston means operably connected to said second barrier for pivoting said second barrier between said positions;

(b) operably connecting said hydraulic means to said second cylinder and piston means;

(c) interposing second electromechanical valve means between said hydraulic means and said second cylinder and piston means;

(d) providing said control station with second switch means in operable connection with said second valve means for controlling operation of said second cylinder and piston means and thereby pivoting of said second barrier; and, (e) pivoting said barriers in response to the first of said switch means to be operated.

22. Operating system for a barricade disposed across a roadway, the barricade including a barrier pivotal between a first lowered position and a second raised position and the barrier in operable connection with hydraulic means comprising an electrically operated motor means and a passive accumulator and including electromechanical valve means interposed between the barrier and the hydraulic means for controlling pivoting of the barrier, the system comprising:

(a) first switch means for operable connection with the valve means for causing operation of the valve means;

(b) first power supply means in operable connection with said switch means and for connection with the valve means for causing the motor means to supply hydraulic fluid for pivoting of the barrier;

(c) second power supply means in operable connection with said switch means and for connection with the valve means for causing the accumulator to supply hydraulic fluid for pivoting of the barrier;

(d) control means for operable connection with the hydraulic means and in connection with said first and second power supply means of monitoring continuous operation of the hydraulic means and for causing pivoting of the barrier to the second position upon cessation of operation of said hydraulic means;

(e) second switch means in operable connection with said first switch means and for connection with the valve means for causing the barrier to pivot to the second position and for thereafter preventing the barrier from pivoting to the first position;

(f) a plurality of indicator lights, each indicator light operably connected to said control means and with one of said motor means and accumulator;

(g) said control means includes monitoring means for determining the operable condition of the motor means and the accumulator and for causing the indicator lights to be continuously illuminated when the associated motor means and accumulator are in an operative condition and for causing the associated indicator light to be extinguished when one of the motor means and accumulator is not in the operative condition; and, (h) at least a first vehicle detector is disposed along the roadway for detecting the approach of a vehicle, said detector for operable connection with the valve means for causing the barrier to pivot to the second position upon the detection of an approaching vehicle.

23. The system of claim 22, further comprising:

(a) a remote control station for being disposed proximate the barricade and including third switch means for operable connection with the valve means for causing selective pivoting of the barrier; and (b) said control means includes means operably associated with said first, second and third switch means for causing operation of the valve means in response to the first one of said first and third switch means to be operated provided that said third switch means has not be operated.

24. The system of claim 23, wherein:

(a) said control means including means for disabling said remote control station and for thereby preventing said second switch means from causing pivoting of the barrier.

25. The system of claim 22, further comprising:

(a) an attendant's booth for being disposed proximate the barricade; and, (b) said first and second switch means, second power supply means and said control means disposed within said booth.

26. The system of claim 22, wherein:

(a) a plurality of said detectors are disposed along the roadway in spaced relation for determining the speed of the vehicle, said detectors for causing the barrier to pivot to the second position when the approaching vehicle has a speed in excess of a selected limit.

27. The system of claim 22, wherein:

(a) visual indicating means being positioned proximate the barricade and for operable connection with the barrier for indicating the position of the barrier; and, (b) audible indicating means being in operable connection with said control means for indicating the occurrence of a defined emergency condition.

28. A vehicle barricade system, comprising:

(a) a barrier disposed across a roadway, said barrier pivotal between a first lowered position and a second raised position;

(b) cylinder and piston means operably associated with said barrier for causing pivoting thereof;

(c) hydraulic means in operable connection with said cylinder and piston means for supplying pressurized hydraulic fluid thereto, said hydraulic means comprising an electrically operated pump means and passive accumulator means;

(d) electromechanical valve means interposed between said hydraulic means and said cylinder and piston means for controlling the flow of hydraulic fluid and thereby pivoting of said barrier;

(e) control means in operable connection with said valve means for causing operation thereof and including first switch means for causing selective pivoting of said barrier and second switch means for causing said barrier to pivot to said second position and for thereafter preventing pivoting to said first position;

(f) first power supply means in operable connection with said valve means for causing said motor means to supply hydraulic fluid to said cylinder and piston means and said second power supply means in operable connection with said valve means for causing said accumulator means to supply fluid to said cylinder and piston means;

(g) monitor means in operable connection with said control means and with said motor and first power supply means for monitoring operation thereof and for causing pivoting of said barrier to said second position upon cessation of operation of one of said motor and first power supply means; and, (h) obstruction detection means operably associated with said barrier for detecting the presence of an obstruction disposed below said barrier and for preventing pivoting of said barrier to said first position upon an obstruction being detected.

29. The system of claim 28, wherein:

(a) a remote control station being disposed proximate said barrier and including third switch means in operable connection with said valve means for causing operation thereof and thereby pivoting of said barrier.

30. The system of claim 29, wherein:

(a) means being operably associated with said control station for disabling said remote control station.

31. The system of claim 28, wherein:

(a) vehicle detector means being disposed along the roadway for detecting the presence of a vehicle approaching said barrier, said detector means being operably connected with said control station for causing pivoting of said barrier to said second position upon the detection of an approaching vehicle.

32. The system of claim 28, further comprising:

(a) a second barrier disposed across the roadway, said second barrier pivotal between a first lowered position and a second raised position;

(b) second cylinder and piston means operably associated with said second barrier for causing pivoting thereof;

(c) means operably connecting said second cylinder and piston means with said hydraulic means for supplying pressurized hydraulic fluid to said second cylinder and piston means;

(d) second electromechanical valve means interposed between said hydraulic means and said second cylinder and piston means;

(e) said control means including third switch means in operable connection with said second valve means for causing operation thereof;

(f) said first and second power supply means being in operable connection with said second valve means for supplying power thereto; and, (g) second obstruction detection means operably associated with said second barrier.

33. The system of claim 28, wherein:

(a) a plurality of vehicle detector means being disposed along the roadway in spaced relation for detecting the approach of and the speed of a vehicle, said detector means causing pivoting of said barrier to said second position when the speed of an approaching vehicle exceeds a selected limit.

* * * * *